US008360679B2

(12) United States Patent
Banks

(10) Patent No.: US 8,360,679 B2
(45) Date of Patent: Jan. 29, 2013

(54) INFLOW AND INFILTRATION CAP AND SEAL BARRIER

(75) Inventor: Robert S Banks, Cannon Falls, MN (US)

(73) Assignee: Strike Tool, Inc., Cannon Falls, MN (US)

( * ) Notice: Subject to any disclaimer, the term of this patent is extended or adjusted under 35 U.S.C. 154(b) by 44 days.

(21) Appl. No.: 13/074,201

(22) Filed: Mar. 29, 2011

(65) Prior Publication Data

US 2012/0251239 A1 Oct. 4, 2012

(51) Int. Cl.
*E02D 29/14* (2006.01)

(52) U.S. Cl. ..... 404/25; 52/19; 52/20; 405/135

(58) Field of Classification Search ..... 404/2–4, 404/25, 26; 52/19, 20; 277/628, 630, 637; 405/135

See application file for complete search history.

(56) References Cited

U.S. PATENT DOCUMENTS

| | | | | |
|---|---|---|---|---|
| 3,385,011 | A | 5/1968 | Sorrell | |
| 3,621,623 | A | 11/1971 | MacMillan Downes | |
| 4,089,139 | A | 5/1978 | Moffa et al. | |
| 4,469,467 | A | 9/1984 | Odill et al. | |
| 4,540,310 | A | 9/1985 | Ditcher et al. | |
| 4,562,674 | A * | 1/1986 | Nelson | 52/171.3 |
| 4,592,674 | A * | 6/1986 | Baliva | 404/25 |
| 4,615,362 | A | 10/1986 | Hartman et al. | |
| 4,648,740 | A * | 3/1987 | Carlson | 404/25 |
| 4,772,154 | A * | 9/1988 | Caroulle | 404/25 |
| 4,927,163 | A | 5/1990 | Gagas | |
| 5,081,802 | A * | 1/1992 | Westhoff et al. | 52/20 |
| 5,240,346 | A * | 8/1993 | Yin | 404/25 |
| 5,299,884 | A | 4/1994 | Westhoff et al. | |
| 5,382,113 | A | 1/1995 | Chilton et al. | |
| 5,613,806 | A | 3/1997 | House et al. | |
| 5,653,559 | A | 8/1997 | Stieb et al. | |
| 5,723,192 | A | 3/1998 | Jonasz | |
| 5,870,871 | A | 2/1999 | Stewart | |
| 6,226,929 | B1 | 5/2001 | Gagas | |
| 6,986,226 | B2 | 1/2006 | Banks | |
| 7,491,010 | B2 | 2/2009 | Cuny et al. | |
| 2005/0058505 | A1 * | 3/2005 | Nadasde | 404/26 |
| 2007/0031190 | A1 * | 2/2007 | Meyers | 404/26 |
| 2007/0116518 | A1 * | 5/2007 | Tortorici | 404/25 |
| 2008/0170908 | A1 * | 7/2008 | Ess | 404/25 |
| 2008/0244988 | A1 * | 10/2008 | Meissen et al. | 52/20 |
| 2011/0268501 | A1 * | 11/2011 | Lee | 404/25 |

* cited by examiner

*Primary Examiner* — Raymond W Addie
(74) *Attorney, Agent, or Firm* — Dietz Law Office LLC

(57) ABSTRACT

An apparatus and method is described for providing a water impenetrable barrier between a cone and support frame of a manhole system. The apparatus includes a barrier, cap, and seal that restricts the inflow and infiltration of water or other debris into the interior of the manhole system. The cap and seal barrier may be implemented in a sanitary sewer, catch basin or other manhole system.

20 Claims, 11 Drawing Sheets

INFLOW AND INFILTRATION CAP AND SEAL BARRIER

CROSS-REFERENCE TO RELATED APPLICATIONS

Not Applicable

FEDERAL SPONSORSHIP

Not Applicable

JOINT RESEARCH AGREEMENT

Not Applicable

TECHNICAL FIELD

This invention pertains generally to roadways and other constructions having manhole or sanitary sewer systems beneath the construction. This invention more particularly pertains to an apparatus that restricts water penetration into the interior of the manhole system.

BACKGROUND

Generally, manhole, sanitary sewer and catch basin systems have previously been described. These systems typically include a concrete base having one or more segments that fit together to form a riser or chimney; a precast concrete cone that rests on top of the uppermost base segment; rectangular or cylindrical adjusting rings aligned and stacked on top of the cone; a steel manhole cover support frame or catch basin support frame, and a steel manhole cover or catch basin grate. During construction of roadways or streets a rubber or other sealing material may be positioned between the joints or seams of the concrete base, cone, and adjusting rings to restrict the flow of fluids either into or out of the manhole or catch basin system.

Although these seals may initially restrict the flow of fluids between the joints, over time, these systems are often subjected to many freeze/thaw cycles, vehicle weight and impact, erosion or other influences which weaken the integrity of the system and deteriorates the sealed joints in the system. Since water finds the path of least resistance, any gap or crack will allow water to works its way through and eventually will likely create leaks large enough for water, dirt, sand, and other debris to seep into the system. Additional freeze/thaw cycles will further deteriorate the system and potentially require significant repair or replacement to the system.

Additionally, it may be desirable to restrict the commingling of sewage and refuse with rain water, snow melts, and other water runoff. Water from rain and melting snow runoff can seep through the ground and enter the system through seams between the cone and the adjusting rings and between the adjusting rings and the cover support frame. Seepage of water may also cause soil erosion around the system. As water enters into the system through any imperfection in the system, the water also carries the surrounding soil into the system, eroding the soil around the system, and eventually causing soil at the ground level to collapse.

Prior devices have been described that attempt to create an impenetrable barrier between the annular adjusting rings and an interior of the system. For example, elastomeric bands, expandable sleeves, and rubber like rope have been described as possible seals for the adjusting rings. Repetitive heavy impact, ground shifting and freeze/thaw cycles all tend to affect the ability of water to penetrate these prior sealing devices. Further, no known prior device describes an apparatus that provides an impenetrable barrier that includes a cover that may be separately removed from the system after the barrier, adjusting rings, and support frame are installed. Also, no known prior device describes a secondary cover that seals and restricts water flow into the interior of the system when the water table rises above the top edge of the seal or during temporary influx of water levels or flooding above ground.

SUMMARY

Embodiments according to aspects of the invention include an apparatus for restricting water penetration into the interior of a manhole system, even during a temporary influx of water above ground level. The apparatus of the invention includes a cylindrical inflow and infiltration gasket that has an opening extending through a central portion of the gasket. The opening provides viewing access there through to the base of the manhole. The gasket engages both an upper surface and side surface of an inflow and infiltration barrier and provides a water tight seal between the gasket and the inflow and infiltration barrier. The gasket also includes a sloped top portion adaptable to receive a cover on the sloped top portion. When the cover is pressed against the sloped top portion, a water tight seal is formed between the gasket and cover, to thereby restrict water from penetrating into an interior of the manhole system. The cover includes a height adjustable eye bolt or pillar that may be adjusted to contact the underside of the manhole cover. When in contact with the manhole cover, the weight of the manhole cover presses the inflow and infiltration cover against the gasket and sealing the barrier even when water flows past the manhole cover.

Alternatively, according to aspects of the invention, the apparatus may include an inflow and infiltration barrier, a gasket, and a cover. The barrier may be of the type that includes an annular rim portion and a sleeve portion extending approximately vertically from the rim portion. The gasket is positioned on top of the sleeve portion of the barrier and is adaptable to engage both a top surface of the sleeve portion and a side of the sleeve. The gasket also has an opening extending through a central portion of the gasket to allow visible inspection below the inflow and infiltration barrier. The cover is positioned above the gasket and is adaptable to engage an upper sloped portion of the gasket. The combination of the barrier, gasket, and cover restricts water from penetrating into an interior of the manhole system between individual spacer rings and generally between the manhole cone and the manhole cover support frame.

In an embodiment of the invention the gasket includes support members to maintain the cover above the gasket when a force is applied to an upper portion of the cover. Further, in an embodiment of the invention, the gasket is constructed from a pliable material and support members extend through a portion of the access opening. In this embodiment, a user desiring access to the base of the manhole may easily bend and pull the gasket from the interior of the manhole to allow access into the interior of the manhole. Additionally, the gasket may further include a concentric annular ledge that may be adapted to receive and engage a lower portion of the cover.

In another embodiment of the invention the gasket includes a downwardly projecting annular flange or shoulder that engages an outer side of the inflow and infiltration barrier. The annular flange provides an additional sealing surface for the water tight seal between the relatively rigid inflow and infiltration barrier and the pliable gasket. The gasket may also include an annular ledge that engages with a lower portion of the cover. The annular ledge may further include annular sealing ridges extending from said annular ledge to provide additional sealing surfaces between the cover and gasket.

Also described herein is an apparatus for restricting inflow and infiltration into a manhole system. The apparatus includes a manhole cone, a manhole cover support frame, a manhole cover, support frame adjustment rings, an inflow and infiltration barrier, an inflow and infiltration gasket, and an inflow and infiltration cover. The inflow and infiltration gasket of this system includes a concentric opening extending through a central portion of the gasket and a sloped top portion. The gasket is adaptable to engage both an upper and side surface of the inflow and infiltration barrier and may also include a sloped top portion that is adaptable to receive the cover. In this manner a water tight barrier is provided restricting water from penetrating into an interior of the inflow and infiltration barrier and the manhole cone. The gasket may further include support members to maintain the cover above the gasket when a force is applied to an upper portion of the cover.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
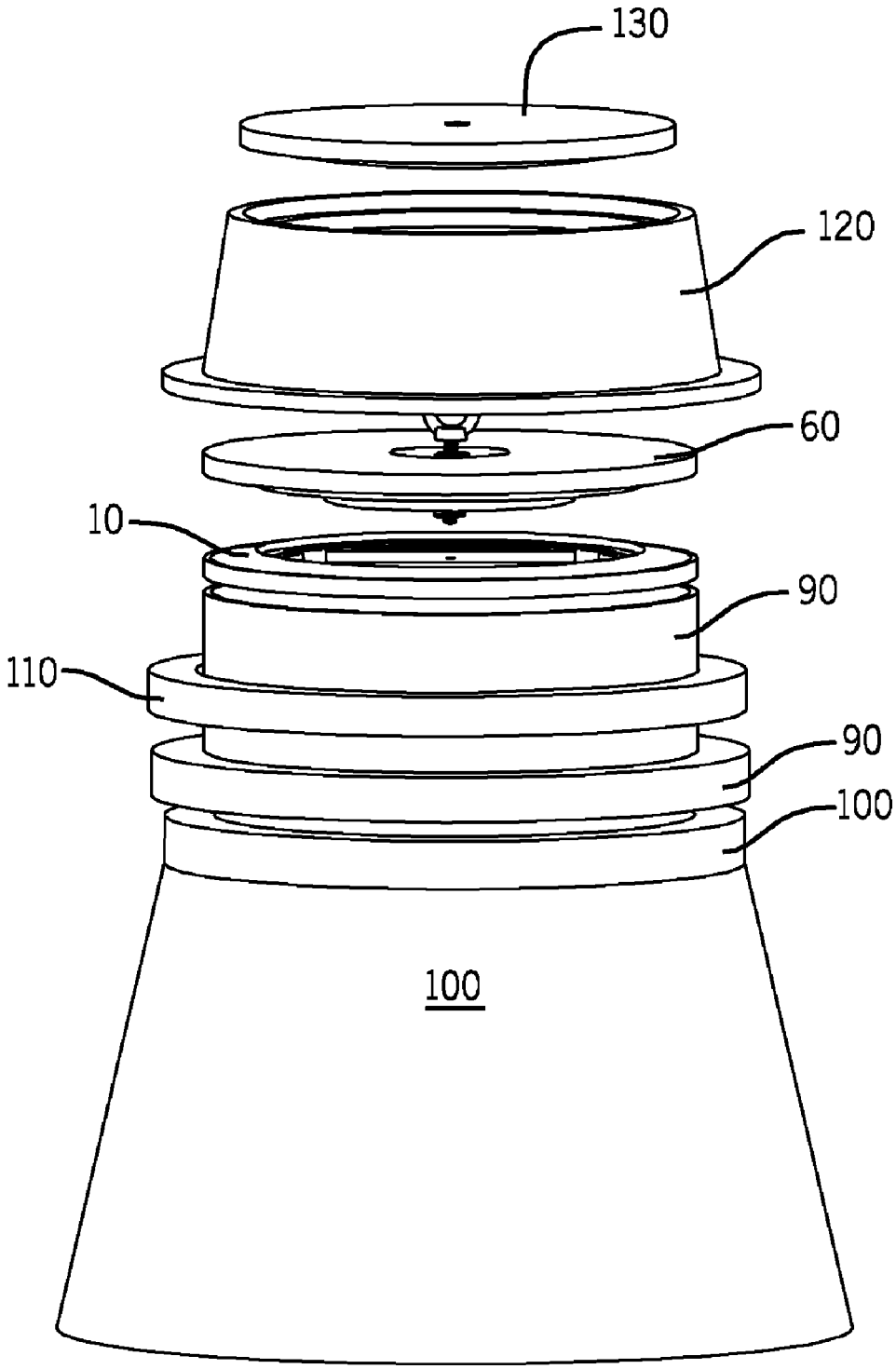
FIG. 1 is a perspective view of a manhole system in accordance with an embodiment of the invention.

The following description provides detail of various embodiments of the invention, one or more examples of which are set forth below. Each of these embodiments are provided by way of explanation of the invention, and not intended to be an undue limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The apparatus for restricting inflow and infiltration into a manhole system of the present invention includes a manhole cone, a manhole cover support frame, a manhole cover, support frame adjustment rings, an inflow and infiltration barrier, an inflow and infiltration gasket, and an inflow and infiltration cover. The inflow and infiltration barrier, gasket, and cover cooperate together to create a barrier that restricts water from penetrating into the interior of a manhole system through seams in the adjusting rings and more generally through seams between the manhole cone and manhole cover support frame.

A user of the apparatus may use the apparatus during initial roadway construction or during repair or renovation of existing roadways. The user positions the inflow and infiltration barrier directly above the cone and stacks the number of desired spacer or adjusting rings on top of the rim of the inflow and infiltration barrier. Once the desired height for grade is reached the user may trim any excess height of the inflow and infiltration barrier likely to interfere with an inner shoulder of the manhole cover support frame. The manhole cover support frame is positioned directly above the stack of adjusting rings. Those skilled in the art will appreciate that, although unnecessary, it may be desirable to use a mortar, cement, caulk, rubber or other adhesive material between the seams of the cone, barrier, spacer rings and support frame to reduce the amount of displacement of the spacer rings and support frame during backfill and creating final grade.

The support frame includes an inner shoulder or lip on which the manhole cover rests. This inner shoulder has an inner diameter that is smaller than the outer diameter of an inflow and infiltration gasket. The gasket is pliable and may be bent to extend the gasket through the access hole of the manhole support frame. Once through the access hole of the support frame the user positions the inflow and infiltration gasket on the upper surface of the inflow and infiltration barrier. A lower annular flange and bottom surface of the inflow and infiltration gasket seals to the upper surface and adjacent side of the inflow and infiltration barrier. A cover of preferably semi rigid material is positioned on the upper surface of the inflow and infiltration gasket. The outer diameter of the cover preferably has a diameter slightly less than the inner diameter of the support frame shoulder so that the cover may be installed either before the manhole cover support frame is positioned above the adjusting rings or after the road construction is complete.

The cover includes an eye bolt or pillar extending from a top surface of the cover that has an adjustable height to increase or decrease the height of the eyebolt from the surface of the cover. The eye bolt height may be adjusted so that a top portion of the eye bolt contacts the underside of the manhole cover. When in contact with the manhole cover, the weight of the manhole cover presses the inflow and infiltration cover against the gasket. Although the shape and configuration of the inflow and infiltration barrier system is described in relation to a manhole or sanitary sewer system, those skilled in the art will appreciate that the shape and dimensions may be modified and adapted so that the inflow and infiltration system is suitable for use within a catch basin or other manhole system.

Figure 2:
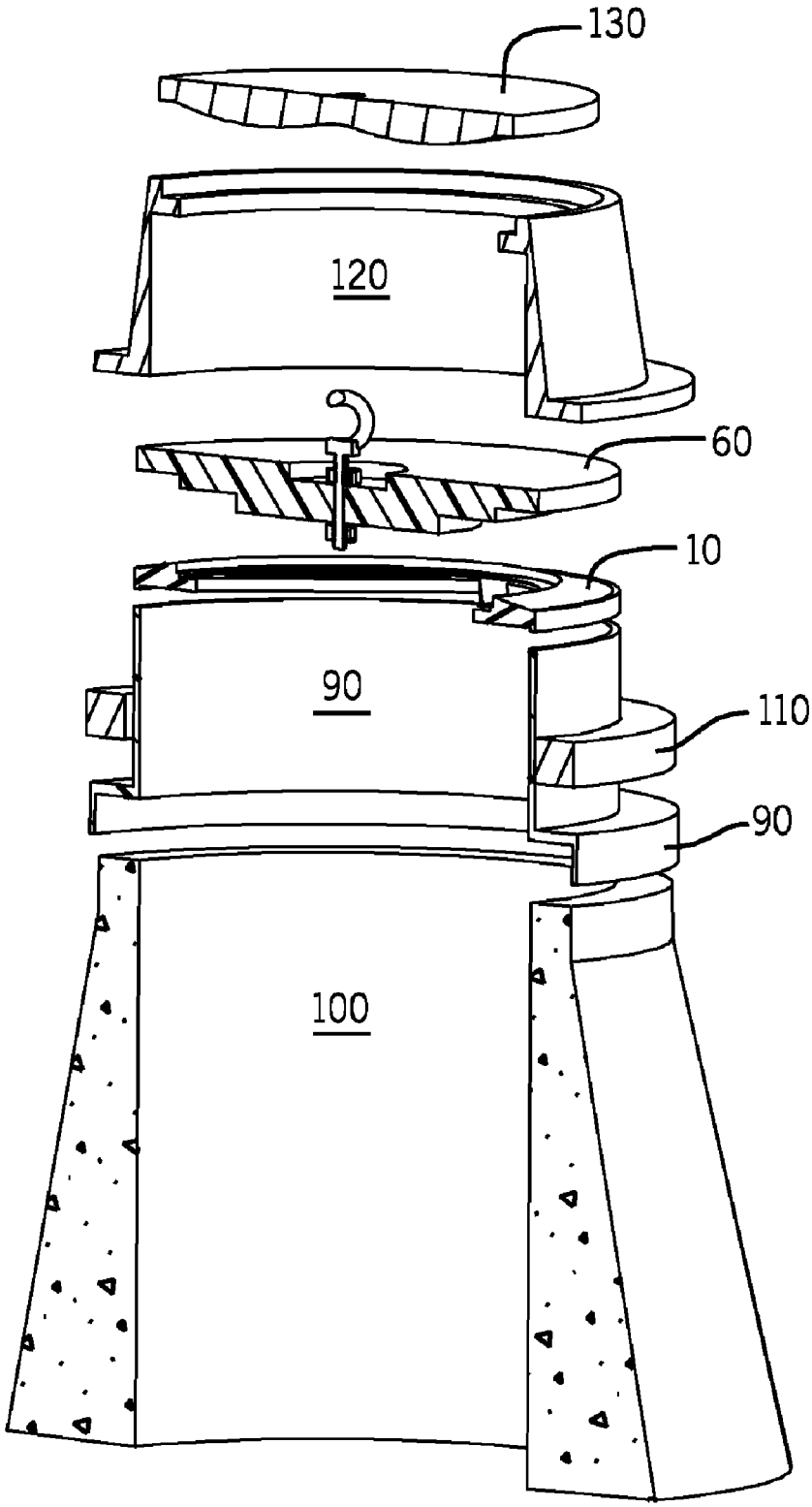
FIG. 2 is a partial sectional perspective view of the manhole system of the type shown in FIG. 1.
Figure 3:
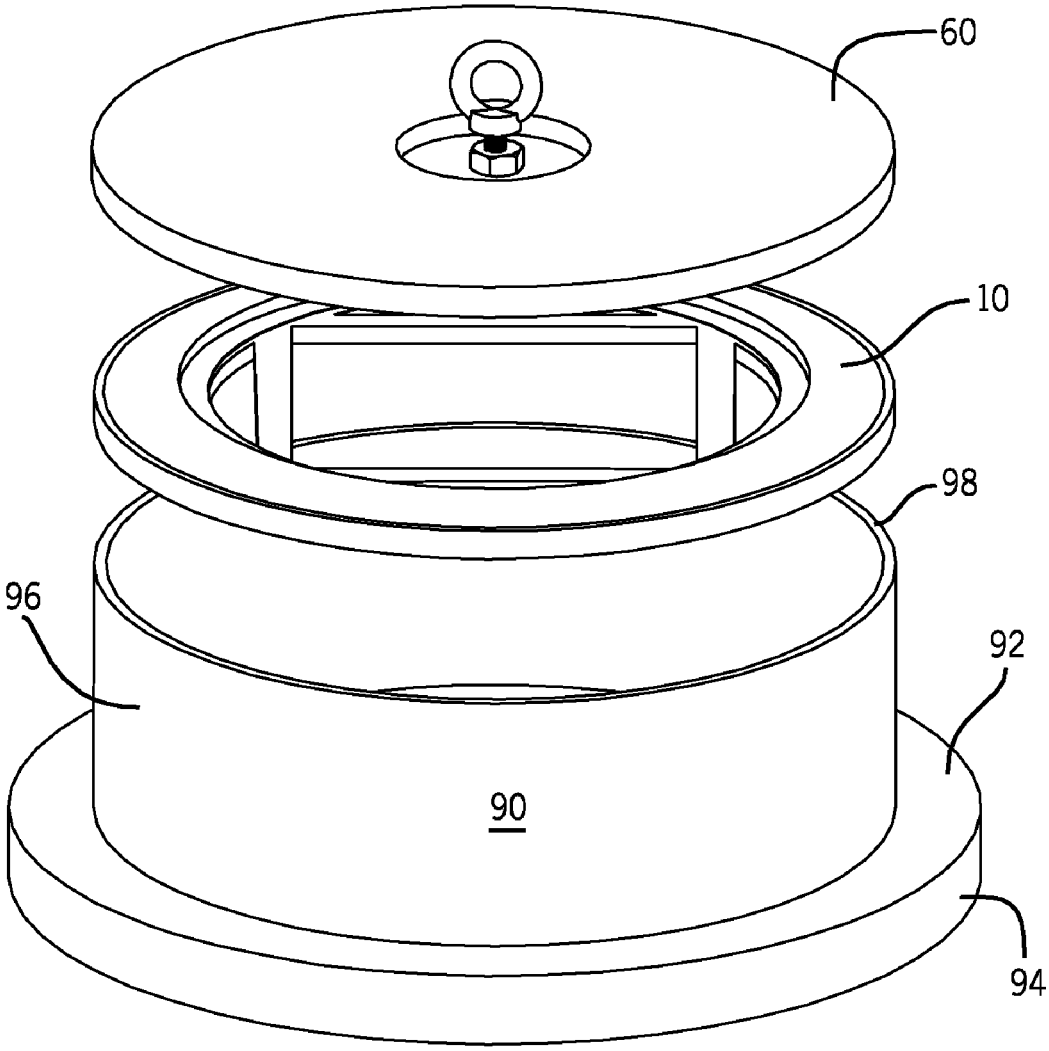
FIG. 3 is a front perspective view of an inflow and infiltration barrier system in accordance with the present invention.
Figure 4:
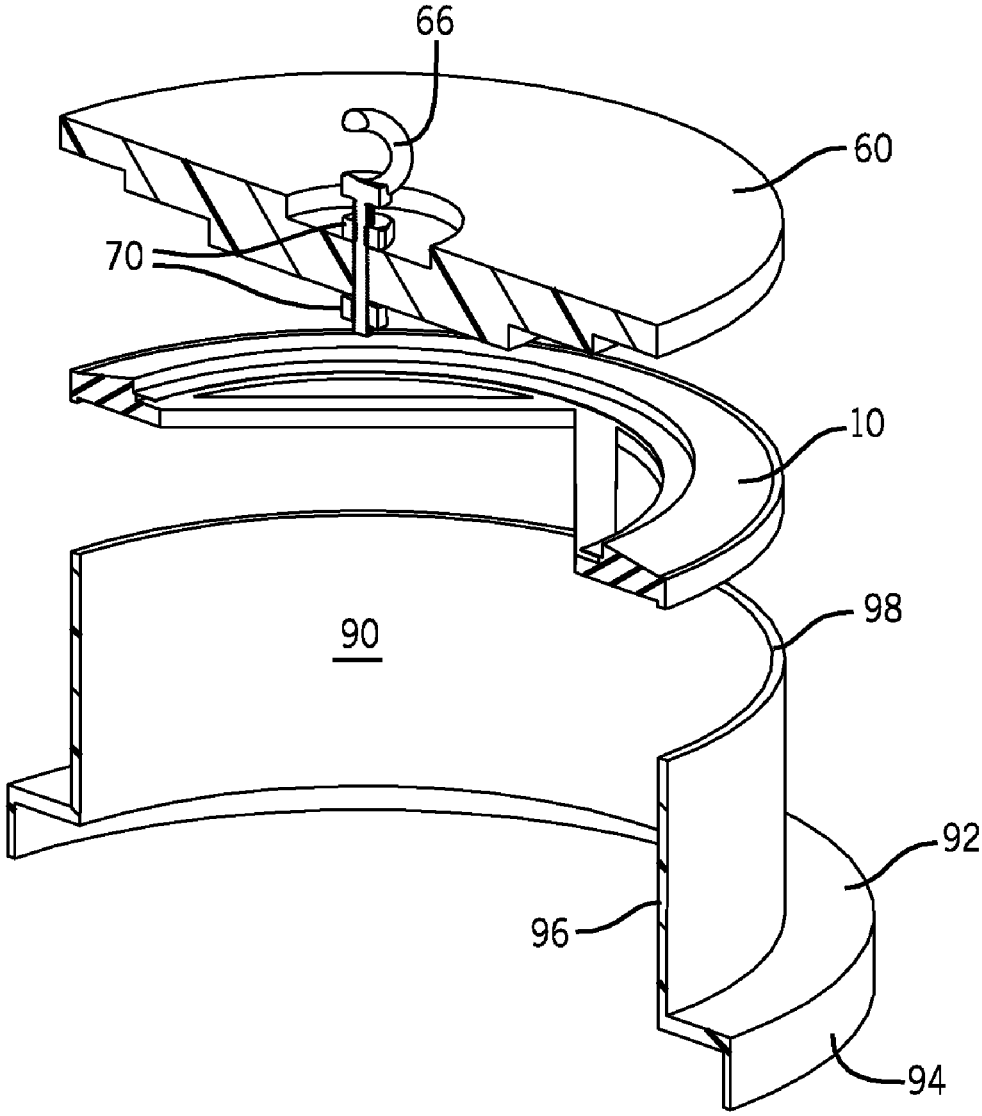
FIG. 4 is a partial sectional top perspective view of the inflow and infiltration barrier system of the type shown in FIG. 3.
Figure 5:
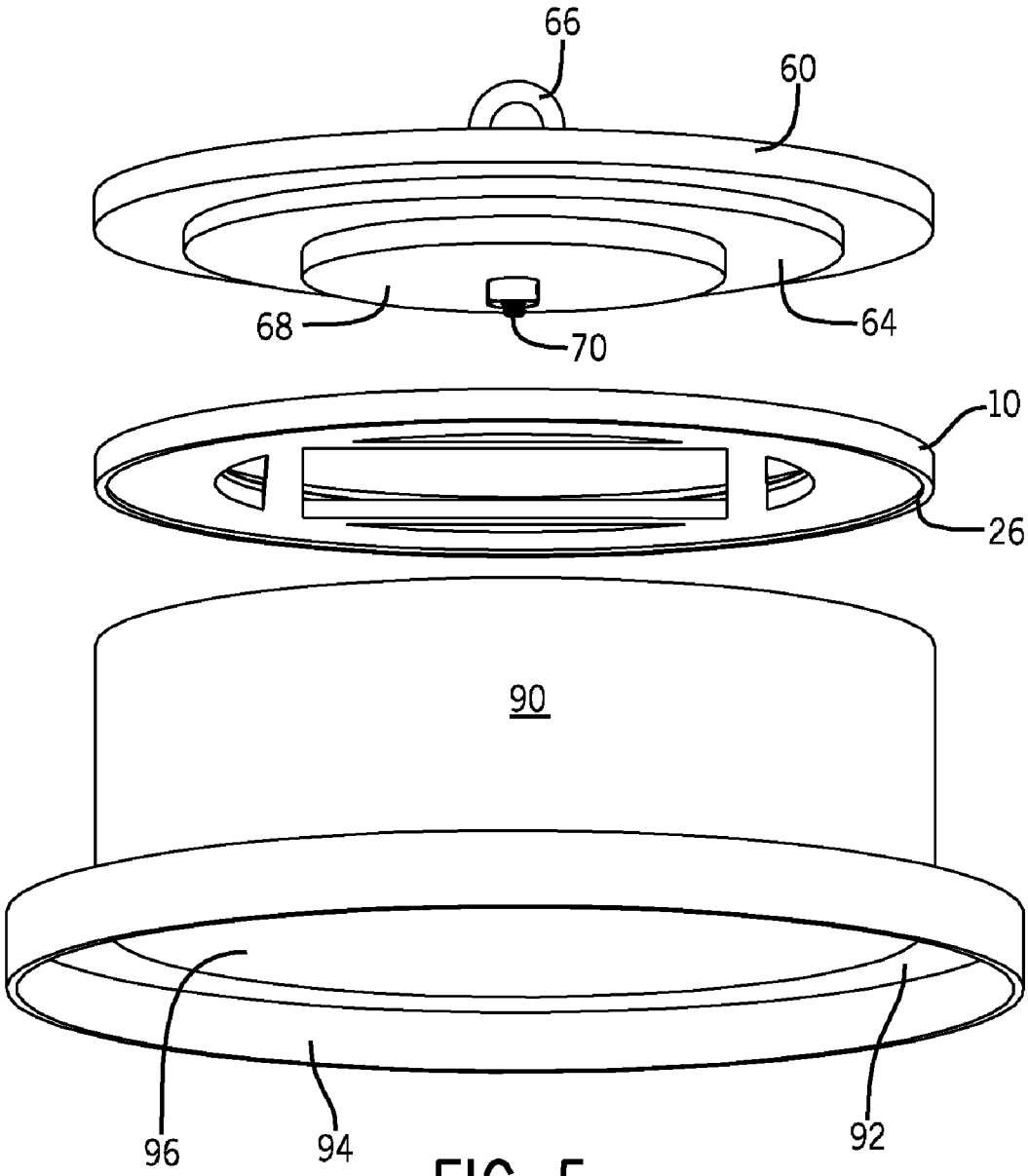
FIG. 5 is a bottom perspective view of an inflow and infiltration barrier system in accordance with an embodiment of the present invention.

Turning attention now to the Figures, embodiments of the apparatus for restricting inflow and infiltration into a manhole system of the present invention will now be described in more detail. The manhole system is generally shown in FIGS. 1-2. The manhole system generally includes a manhole cone 100, a manhole cover support frame 120, a manhole cover 130, support frame adjustment rings 110, an inflow and infiltration barrier 90, an inflow and infiltration gasket 10, and an inflow and infiltration cover 60. The base of cone 100 is sized to match the size of the manhole base (not shown). The cone sidewalls narrow to form a smaller diameter opening and ledge on which the barrier 90, adjusting rings 110, and support frame 120 are stacked.

The diameter of the cone opening is typically sized to allow passage there through by a user carrying an oxygen tank or other backpack and supplies. Municipalities or cities often times will specify the minimum requirements for this opening. The adjusting rings may be made of a suitable construction and, by way of example, may preferably be precast, made from a polymer, constructed from brick and mortar, or cast on site as a single ring with the desired thickness to elevate the upper portion of the manhole cover support frame 120 at grade level.

FIGS. 3-6 show generally an embodiment of the inflow and infiltration barrier 90, gasket 10, and cover 60. The inflow and infiltration barrier 90 includes an annular rim 92, flange 94 extending downward from an outer edge of the rim 92, a sleeve 96 extending upward from an inner edge of the rim 92 and an upper edge or surface 98. The annular rim 92 rests on top of the cone 100 and is sized so that an access opening in the barrier 90 approximates the access opening of the cone 100. The annular flange 94 extends over and around the upper outer side edge of the cone 100. The inner diameter of the annular flange is slightly greater than the outer diameter of the cone near the upper outer side edge of the cone. In this manner the annular flange 94 slips over an upper side of the cone 100. Once the barrier 90 is positioned on top of the cone 100, the flange 94 reduces the ability of the barrier to slip off the top of the cone. The sleeve 96 acts as a centering and alignment member for the adjusting rings 110 and the barrier 90 affectively reduces the ability of the adjusting rings from slipping off the manhole cone. Further, as water seeps through the ground adjacent the manhole structure, the barrier diverts, downward below the top of the cone, any water that may flow between the seams of the adjusting rings.

The inflow and infiltration gasket 10 rests and seals on the top edge or surface 98 of the barrier sleeve 96. The gasket 10 further seals against an upper side surface of the sleeve 96. Similarly, the cover 60 rests on the gasket 10 and contacts the gasket to form a water tight seal between the cover 60 and gasket 10. In the event that water is able to flow or rise up above the height of the inflow and infiltration barrier 90 the water tight seal between the gasket 10 and barrier 90 and the water tight seal between the cover 60 and gasket 10 restricts water from entering into the interior of the manhole system.

With reference to FIGS. 7-12 the gasket 10 will be further described. The inflow and infiltration gasket 10 generally includes a cylindrical main body 12 having an open center portion 14, a sloped top portion 20, a flange 26 extending from an outer bottom edge of the main body 12, an inner circumferential ledge 32 adaptable to receive and seal to cover 60, and support members 40. The opening 14 allows for visual inspection of the interior of the manhole without removing the gasket. The sloped top portion 20 of gasket 10 provides a multi-dimensional sealing surface on which the cover rests and seals. The gasket main body has an approximately uniform thickness along outer edge 16 and a different but approximately uniform thickness along an inner edge 18. The difference in thickness between the outer edge 16 and inner edge 18 defines the sloped surface 20 of the main body 12.

The support members 40 may comprise multiple configurations extending from a first inner side of the main body 12 to a second inner side of the main body 12. In one preferred embodiment of the invention, multiple support members 40 intersect at an inner sidewalls of main body 12 to form a square. The support members 40 are located within the opening 14 and engage with the cover 60. The outer diameter of the cover is less than the inner diameter of the sleeve 96 of barrier 90 and the outer diameter of gasket 10. If a force is applied to a top of the cover 60 resting on the flexible gasket 10 the support members 40 maintain the cover above the gasket 10 and restrict the cover 60 from pushing through the central access opening 14 of gasket 10.

Inflow and infiltration cover 60 includes an eyebolt extending from a top surface of the cover 60. Nuts 70 on both the top and bottom of the cover are threaded onto bolt 66 and may be tightened against the cover to fix the bolt 66 at a desired height. It may be desirable to extend the bolt 66 to a sufficient height from the cover so that the bolt 66 contacts the underneath of the manhole cover. In this manner the height may be adjusted so that when the bolt contacts the manhole cover, the weight of the manhole provides a force against the bolt which in turn forces the inflow and infiltration cover against the gasket. The height may be further adjusted such that the force is sufficient to slightly compress the gasket 10. The top surface of the inflow and infiltration cover 60 is shown recessed to provide a pocket for the eye of bolt 66 to recede. When the distance or height between the manhole cover and the inflow and infiltration cover 66 is minimal, it may be necessary for a portion of the eye bolt to recede in the pocket.

The multidimensional sealing surface of gasket 10 further increases the ability to seal the inflow and infiltration cover to the gasket even when irregularities in the flatness of the cover exist. The annular ledge 32 also provides a sealing contact site between the cover 60 and gasket 10. Additionally, one or more annular ridges 36 extend upward from the ledge 32 and provide another multidimensional sealing surface on which portion 64 of the cover 60 may rest and seal.

Figure 6:
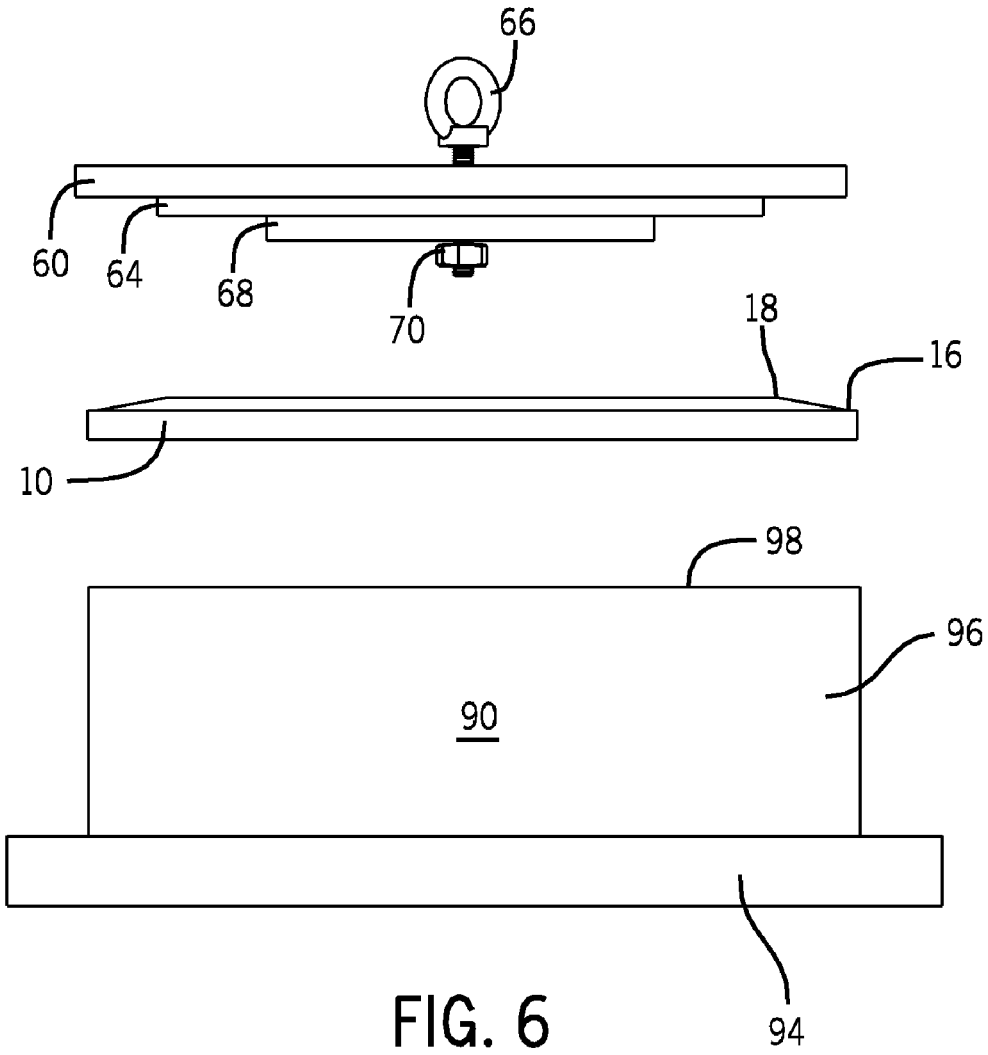
FIG. 6 is a side view of an inflow and infiltration barrier system in accordance with an embodiment of the present invention.
Figure 7:
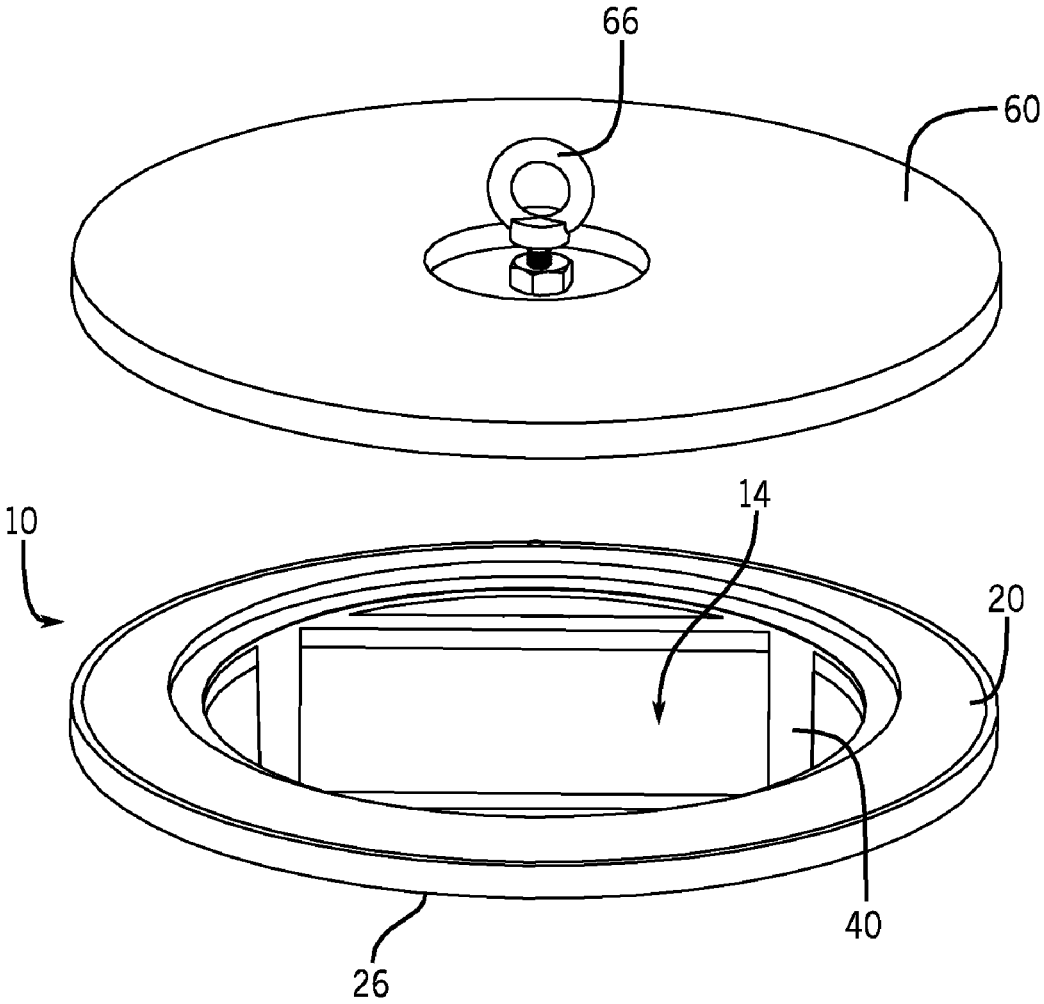
FIG. 7 is a top perspective view of an inflow and infiltration cover and gasket in accordance with an embodiment of the present invention.
Figure 8:
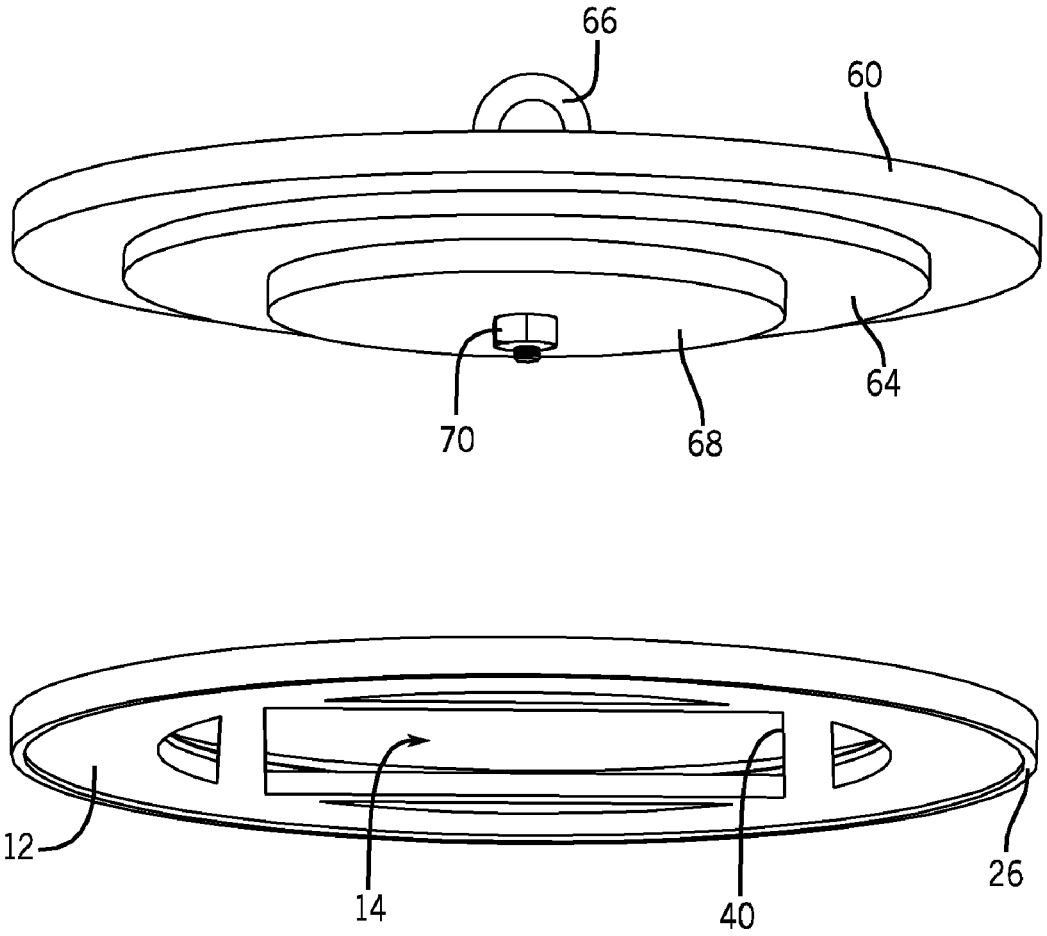
FIG. 8 is a bottom perspective view of an inflow and infiltration cover and gasket in accordance with an embodiment of the present invention.
Figure 9:
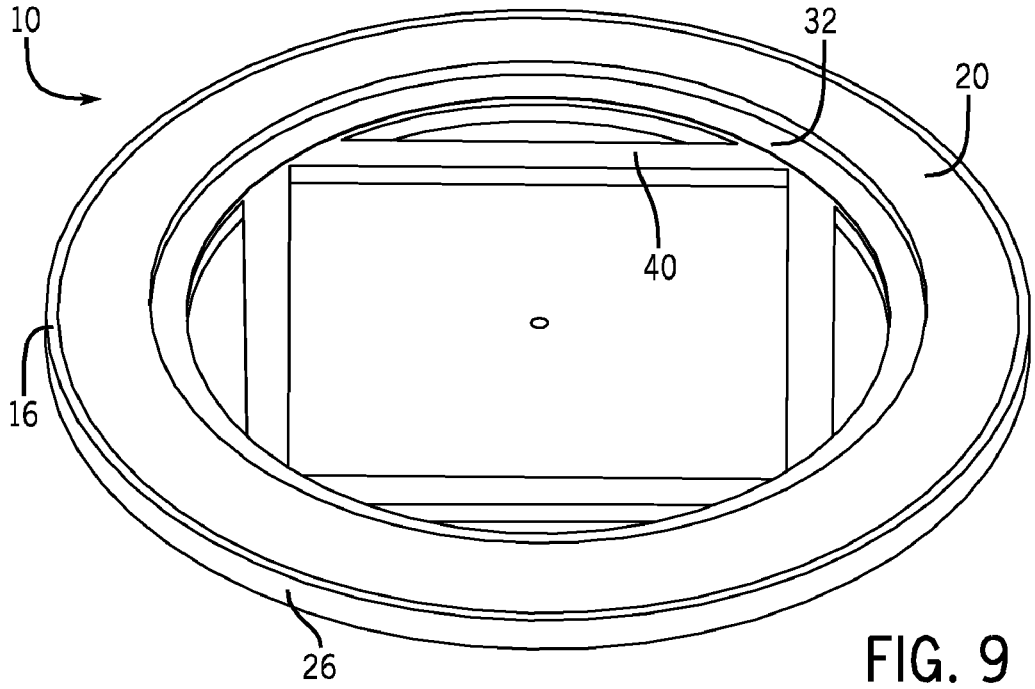
FIG. 9 is a top perspective view of an inflow and infiltration gasket in accordance with an embodiment of the present invention.
Figure 10:
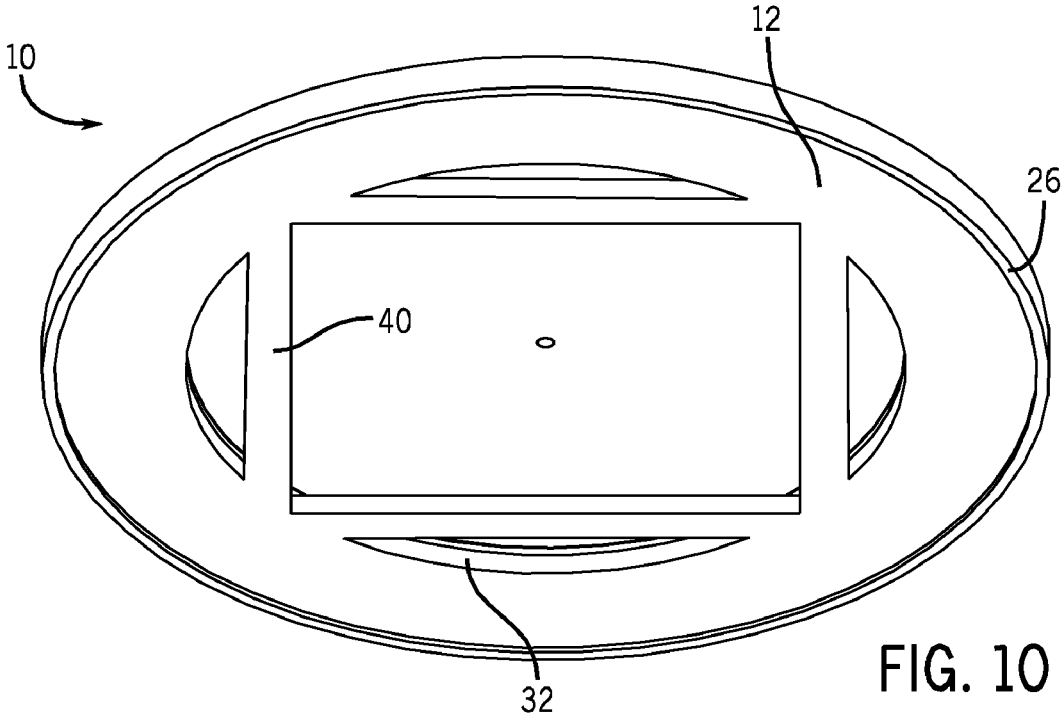
FIG. 10 is a bottom perspective view of an inflow and infiltration gasket in accordance with an embodiment of the present invention.
Figure 11:
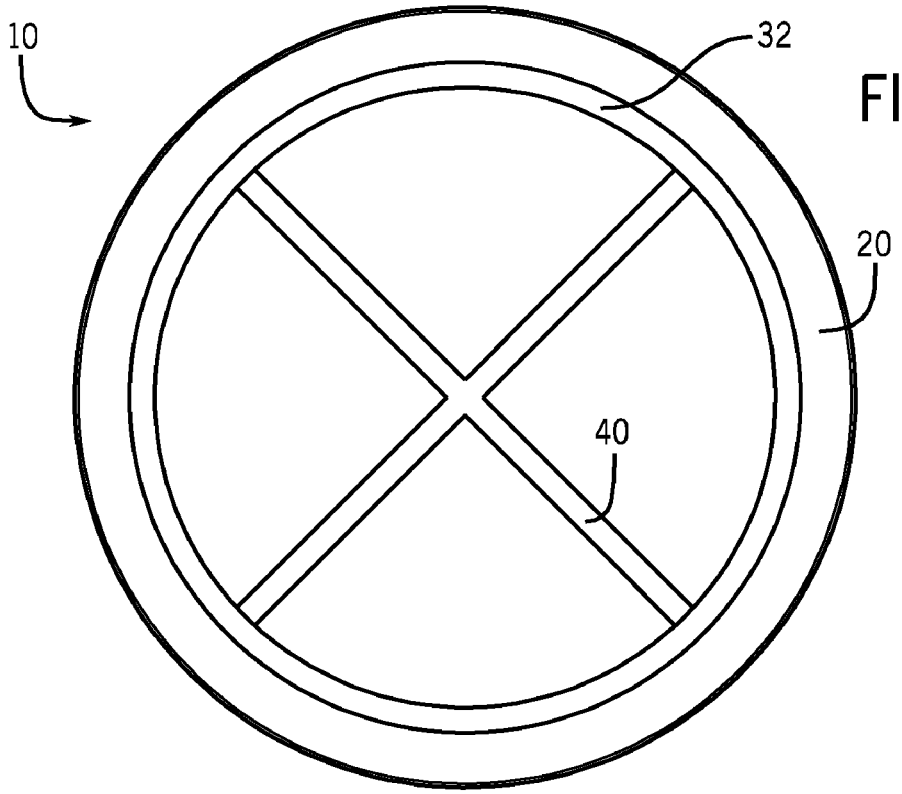
FIG. 11 is a top view of an inflow and infiltration gasket in accordance with an embodiment of the present invention.
Figure 12:
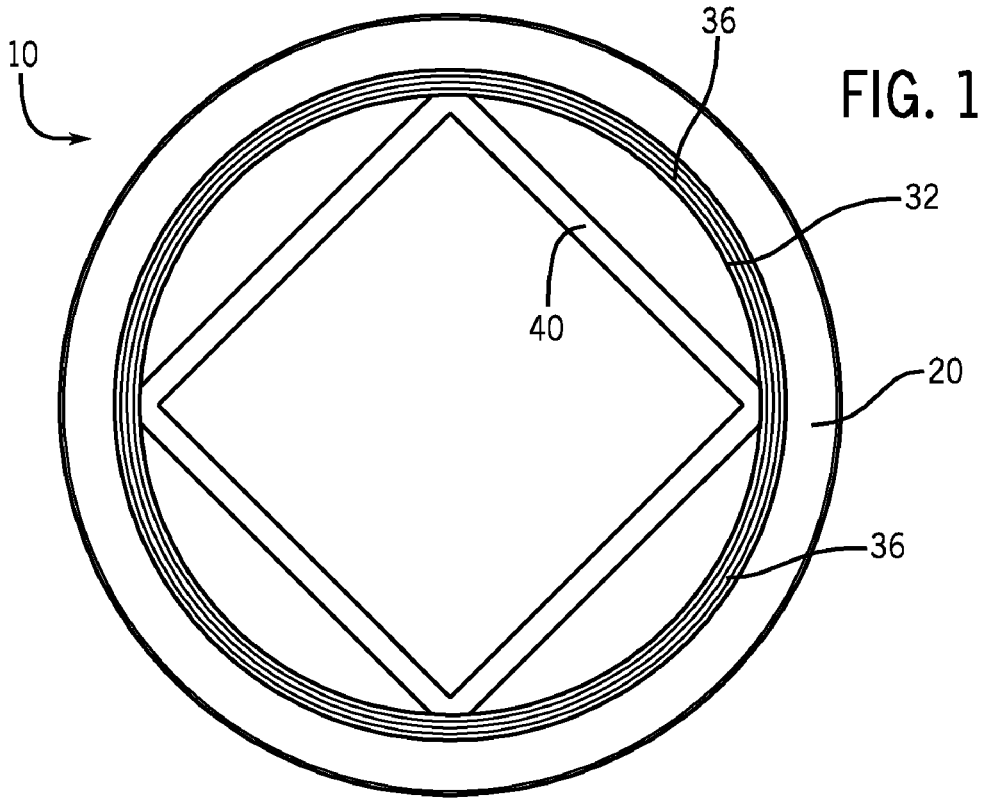
FIG. 12 is a top view of an inflow and infiltration gasket in accordance with an embodiment of the present invention.
Figure 13:
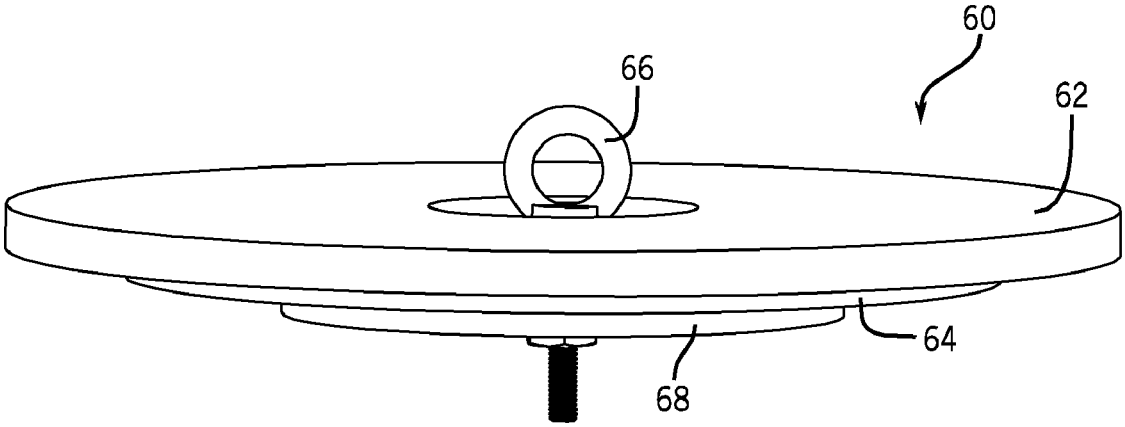
FIG. 13 is a top perspective view of an inflow and infiltration cover in accordance with an embodiment of the present invention.
Figure 14:
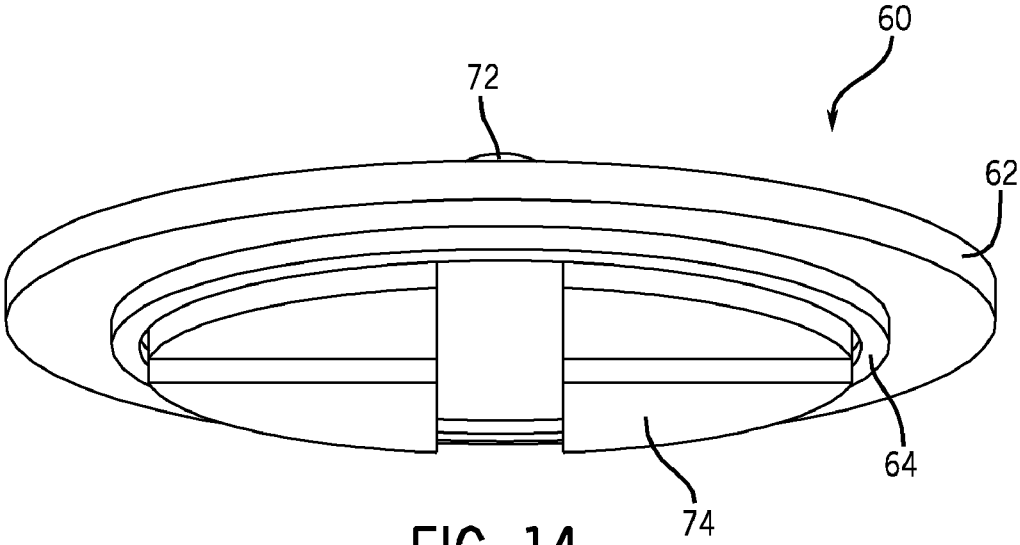
FIG. 14 is a bottom perspective view of an inflow and infiltration cover in accordance with an embodiment of the present invention.

As shown in FIGS. 13 and 14, cover 60 includes a cylindrical body 62, brim 64, eye bolt 66 and nuts 70. The nuts may be eliminated by providing a threaded hole through the cover suitable for receiving the threaded bolt 66. The brim 64 is dimensioned to fit within and engage to the ledge 32 of gasket 10. The eye bolt 66 may be of a suitable known construction to allow the user to insert and remove the cover 66 from the manhole system and to act as an adjustable spacer that engages the manhole cover and the inflow and infiltration cover 60. Use of an eyebolt as the handle, as shown in FIG. 6 provides for a convenient attaching mechanism to attach a rope or the like to the cover 60. Alternatively, a handle 72 may extend from a top surface of cover 66. The brim 64 may further include a shoulder portion 68 or wedges 74 (see FIG. 14) that insert into the opening 14 of the gasket 10 between support members 40. The shoulder portion 68 or wedges 74 may assist the user to align the cover relative to the gasket in a preferred orientation.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. An apparatus for restricting inflow and infiltration into an interior of a manhole, comprising:

an inflow and infiltration barrier adaptable for positioning between a manhole cover support frame and a manhole cone, said barrier having an annular rim portion and a sleeve portion extending approximately vertically from the rim portion;

a gasket adaptable to engage both a top surface of said sleeve portion and an outwardly facing, external side of said sleeve portion and having an opening extending through a central portion of said gasket; and a cover adaptable to engage a sloped top portion of said gasket.

2. The apparatus as recited in claim 1, wherein said cover is further adaptable to engage an inner annular ledge of said gasket.

3. The apparatus as recited in claim 1, wherein said inflow and infiltration barrier includes a flange extending downwardly from an outer edge of said annular rim.

4. The apparatus as recited in claim 1, wherein said gasket includes a downwardly projecting annular flange that engages the outwardly facing external side of said sleeve portion of said inflow and infiltration barrier.

5. The apparatus as recited in claim 1, wherein said sloped top portion of said gasket has a first approximately uniform thickness on an outer circumference edge and a second approximately uniform thickness on an inner circumference edge, wherein said first thickness differs from said second thickness.

6. The apparatus as recited in claim 2, wherein said annular ledge of said gasket further includes annular sealing ridges extending from said annular ledge.

7. The apparatus as recited in claim 1, wherein said gasket includes support members to maintain said cover above said gasket when a force is applied to an upper portion of said cover.

8. The apparatus as recited in claim 7, wherein said support member extends through a portion of said opening of said gasket from a first concentric inner annular side to a second concentric inner annular side.

9. The apparatus as recited in claim 1, wherein said gasket is constructed from a relatively pliable material and said inflow and infiltration barrier is constructed of a relatively rigid material.

10. A device for restricting water penetration through an upper portion of an inflow and infiltration barrier comprising:

a cylindrical inflow and infiltration gasket having, a concentric opening extending through a central portion of said gasket and having a sloped top portion that forms an annular tapered body portion, wherein said gasket being adaptable to engage both an upper edge and external side surface of an inflow and infiltration barrier, and further wherein said sloped top portion is adaptable to receive a cover thereon to thereby create a water tight barrier restricting water from penetrating into an interior of the inflow and infiltration barrier.

11. The apparatus as recited in claim 10, wherein said gasket includes support members to maintain the cover above said gasket when a force is applied to an upper portion of the cover.

12. The apparatus as recited in claim 11, wherein said support member extends through a portion of the concentric opening.

13. The apparatus as recited in claim 10, wherein said gasket is constructed from a relatively pliable material and the inflow and infiltration barrier is constructed of a relatively rigid material.

14. The apparatus as recited in claim 10, wherein said gasket further includes a concentric annular ledge adaptable to engage a lower portion of the cover.

15. The apparatus as recited in claim 10, wherein said gasket includes a downwardly projecting annular flange that engages an outer side of the inflow and infiltration barrier.

16. The apparatus as recited in claim 10, wherein said sloped top portion of said gasket has a first approximately uniform thickness on an outer circumference edge and a second approximately uniform thickness on an inner circumference edge, wherein said first thickness differs from said second thickness.

17. The apparatus as recited in claim 14, wherein said annular ledge of said gasket further includes annular sealing ridges extending from said annular ledge.

18. An apparatus for restricting inflow and infiltration into a manhole system, comprising:

a manhole cone defining a base of the manhole system;

a manhole cover support frame positioned above said manhole cone;

a manhole cover;

support frame adjustment rings positioned between said manhole cone and said manhole cover support frame;

an inflow and infiltration barrier positioned between said manhole cone and said manhole cover support frame, said inflow and infiltration barrier having an annular rim portion and a sleeve portion extending approximately vertically from the rim portion wherein said support frame adjustment rings are positioned above the annular rim and exterior to the sleeve portion of the inflow and infiltration barrier;

an inflow and infiltration gasket; and an inflow and infiltration cover.

19. The apparatus of claim 18, wherein said gasket includes a concentric access opening extending through a central portion of said gasket and a sloped top portion, wherein said gasket being adaptable to engage both an upper edge and external side surface of said inflow and infiltration barrier, and further wherein said sloped top portion is adaptable to receive said cover thereon to thereby create a water tight barrier restricting water from penetrating into an interior of said inflow and infiltration barrier and said manhole cone.

20. The apparatus as recited in claim 19, wherein said gasket includes support members to maintain said inflow and infiltration cover above said gasket when a force is applied to an upper portion of said inflow and infiltration cover.

* * * * *